US006655973B2

(12) United States Patent
Ji et al.

(10) Patent No.: US 6,655,973 B2
(45) Date of Patent: Dec. 2, 2003

(54) ELECTRICAL CARD CONNECTOR WITH CARD EJECT MECHANISM

(75) Inventors: Zhangjiang Ji, Kunsan (CN); Qiang Chen, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/167,317

(22) Filed: Jun. 10, 2002

(65) Prior Publication Data

US 2003/0199186 A1 Oct. 23, 2003

(30) Foreign Application Priority Data

Apr. 18, 2002 (TW) ..... 91205217 U

(51) Int. Cl.[7] ..... H01R 13/62
(52) U.S. Cl. ..... 439/159; 439/607; 439/160
(58) Field of Search ..... 439/159, 152, 439/153, 155, 157, 160, 64

(56) References Cited

U.S. PATENT DOCUMENTS 6,074,227 A * 6/2000 Ho et al. ..... 439/159
6,113,403 A * 9/2000 Oguchi ..... 439/159
6,247,946 B1 * 6/2001 Nakamura et al. ..... 439/159
6,273,737 B1 * 8/2001 Furusho et al. ..... 439/159
6,319,029 B2 * 11/2001 Nishioka ..... 439/159
6,379,167 B1 * 4/2002 Zhang et al. ..... 439/157

* cited by examiner

*Primary Examiner*—Hien Vu
(74) *Attorney, Agent, or Firm*—Wei Te Chung

(57) ABSTRACT

An electrical card connector (100) includes an insulative base (10), a plurality of conductive terminals (30), a card eject mechanism (40) assembled to the base, and a shield (20). The insulative base defines a locking indentation (11) at a rear end thereof. The card eject mechanism includes a movable member (42), a coil spring (43) and a link rod (41). The link rod has a first end (412) engaging with the movable member at either a locking position ("A") or a releasing position ("B") of the movable member and a second end (411) received in the indentation of the base. The shield has a hook (21) received in the indentation of the base and engaged with the rear end of the link rod, thereby securing the rear end of the link rod to the base.

7 Claims, 5 Drawing Sheets

ELECTRICAL CARD CONNECTOR WITH CARD EJECT MECHANISM

BACKGROUND OF THE INVENTION

1. Field of the Invention

The present invention generally relates to an electrical card connector, and more particularly to an electrical card connector with an improved card eject mechanism.

2. Description of the Related Art

Electrical card connectors used for Multimedia cards (MMC) or Secure Digital (SD) cards usually have card eject mechanisms for ejecting inserted cards.

Japanese Patent Publication Nos. 2000-251024, 2000-251025, U.S. Pat. No. 6,332,791B1 and Publication No. 2001/0055896A1 disclose electrical card connectors with similar card eject mechanisms. FIG. 5 shows a card eject mechanism 6 of an electrical card connector disclosed in US Publication No. 2001/0055896A1. The card eject mechanism 6 includes a coil spring 62, a movable member 63, a link rod 64, and a curved guide groove 66 defined in a base 60 encircling a heart-shaped cam 65. The guide groove 66 defines a locking position "C" and a releasing position "D". The coil spring 62 has a front end secured to the base 60 and a rear end connected to the movable member 63. A rear portion of the movable member 63 is linked with a front end of the link rod 64. A rear end of the link rod 64 is engaged in the locking position "C" when a card is fully received in the connector and engaged in the releasing position "D" when the card is pushed out of the connector. However, the guide groove 66 described above is defined in an upper portion of the base 60, thereby enlarging the width of the base 60. Moreover, the link rod 64 and the movable member 63 are usually required to be hingably linked, which requires a relatively complicated process.

Japanese Patent Publication No. 11-135192 discloses another conventional electrical card connector with a card eject mechanism. The card eject mechanism includes a coil spring, a movable member, and a link rod. The movable member defines a guide groove in a lateral side thereof. The guide groove defines a locking position and a releasing position. One end of the coil spring is secured to a base of the electrical card connector and the other end of the coil spring is connected with the movable member. The link rod has one end secured to the base by insert-molding. The other end of the link rod is received in the guide groove of the movable member and engaged in the locking position when a card is fully received in the electrical card connector and engaged in the releasing position when the card is ejected. However, one end of the link rod is insert-molded with the base, which requires a relatively complicated process and thus increases manufacturing cost.

JP Patent Publication No. 2001-85089 discloses an electrical card connector with a card eject mechanism similar to that of Japanese Patent Publication No. 11-135192. A link rod of the electrical connector is secured to a base by riveting, which takes up much more space and also requires a relatively complicated process.

Hence, an electrical card connector with an improved card eject mechanism is needed to overcome the foregoing shortcomings.

BRIEF SUMMARY OF THE INVENTION

A main object of the present invention is to provide an electrical card connector with an improved card eject mechanism. A link rod of the card eject mechanism is secured to a base by a rear side of a shield.

Another object of the present invention is to provide an electrical card connector with an improved card eject mechanism which is easy for manufacturing and assembly.

An electrical card connector comprises an insulative base, a plurality of conductive terminals, an card eject mechanism and a shield. The insulative base defines a locking indentation at a rear end thereof. The card eject mechanism includes a movable member, a coil spring and a link rod. The link rod has a first end engaging with the movable member at either a locking position or a releasing position of the movable member and a second end received in the indentation of the base. The shield has a hook received in the indentation of the base and engaged with the rear end of the link rod, thereby securing the rear end of the link rod to the base.

Other objects, advantages and novel features of the invention will become more apparent from the following detailed description when taken in conjunction with the accompanying drawings.

DETAILED DESCRIPTION OF THE INVENTION

Figure 1:
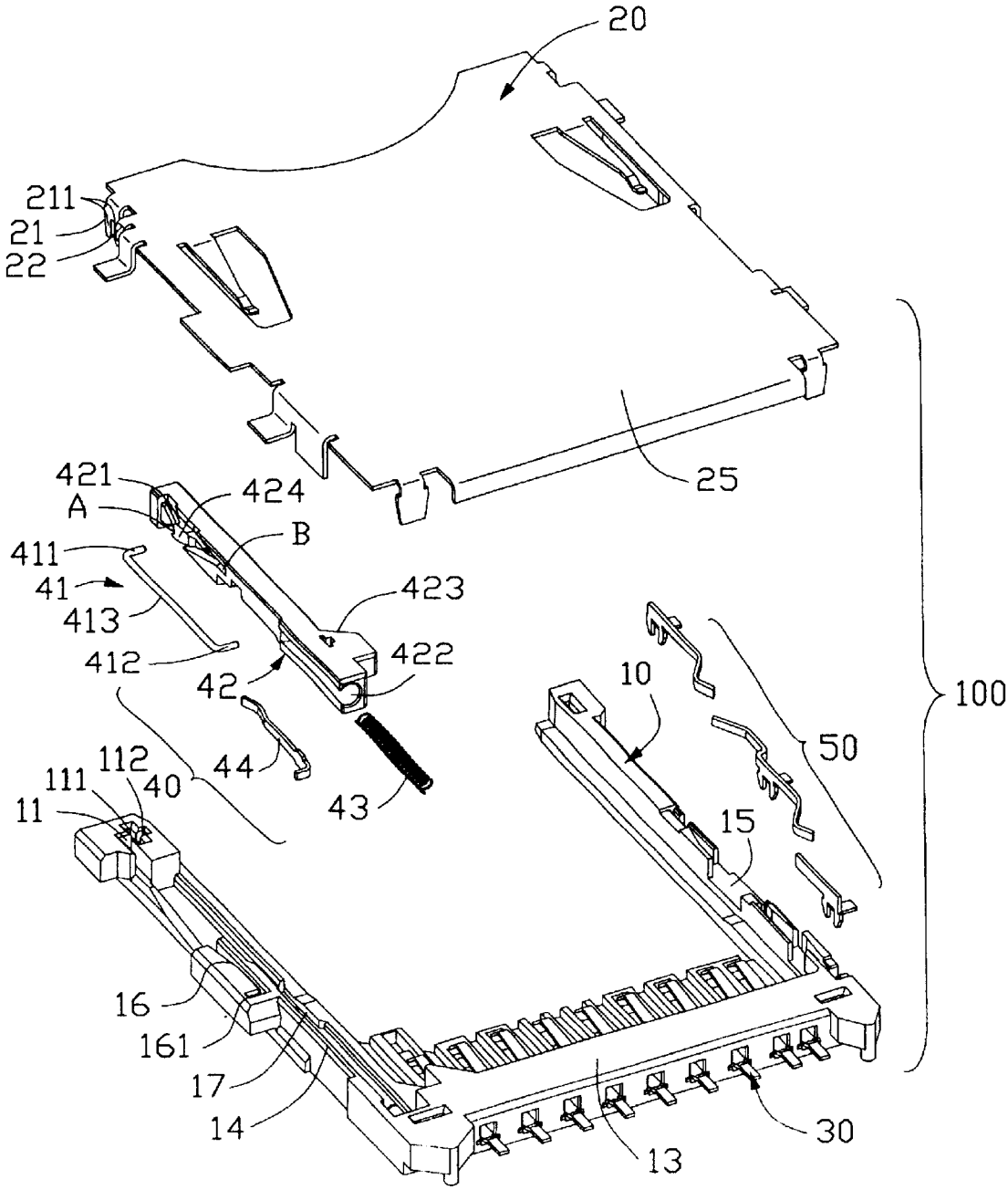
FIG. 1 is an exploded perspective view of an electrical card connector according to the present invention.

Referring to FIG. 1, an electrical card connector 100 according to the present invention includes an insulative base 10, a plurality of conductive terminals 30 received in the base 10, a card eject mechanism 40 for smoothly and easily ejecting an electronic card (not shown) inserted in the connector 100, switch contacts 50 for detecting write-protect of the card and full insertion of the card, and a shield 20. Since the structure of the conductive terminals 30 and the switch contacts 50 are well known to those skilled in the art, a detailed description thereof is omitted herein.

The base 10 includes a traverse portion 13 with the conductive terminals 30 insert-molded therewith, and a first and a second arms 14, 15. The first arm 14 defines a longitudinal groove 17 in a top surface thereof. A projection 16 extends laterally from a middle portion of the first arm 14. The projection 16 defines an L-shaped locking recess 161 in a top surface thereof. A locking indentation 11 is defined at a distal end of the first arm 14. The locking indentation 11 is generally crossed and includes a longitudinal part 111 and a traverse part 112. The longitudinal part 111 extends vertically through the top surface and a bottom surface of the first arm 14. The traverse part 112 communicates with the longitudinal part 111 extend only through the top surface of the first arm 14.

The card eject mechanism 40 includes a coil spring 43, a movable member 42, a link rod 41 and a retention element 44. The movable member 42 defines a curved guide groove 421 in a lateral side thereof which encircles a heart-shaped cam 424. A substantially semi-circular channel 422 is defined at a front end of the movable member 42. The movable member 42 further has an actuation portion 423 extending laterally from a front portion thereof. The link rod 41 has a longitudinal portion 413, and a front and a rear ends 412, 411 respectively extending laterally from opposite ends of the longitudinal portion 413.

The shield 20 includes a substantially rectangular main body 25. A forked hook 21 depends from a lateral side of the main body 25 adjacent to a rear end thereof. The hook 21 has a pair of downward legs 211. A tab 22 also depends from the same side of the main body 25 and located in front of the forked hook 21.

Figure 2:
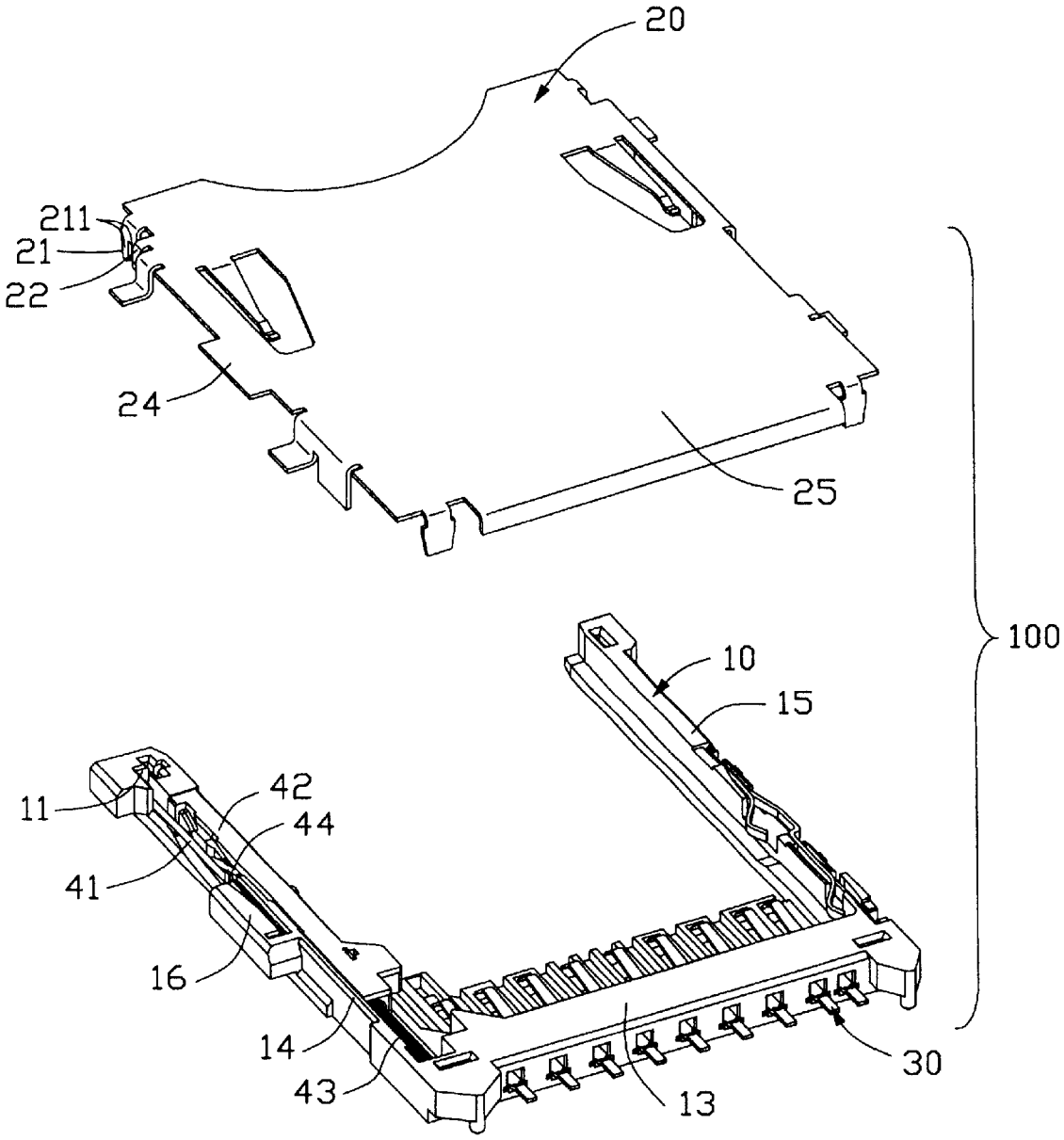
FIG. 2 is a partially exploded view of the electrical card connector, with a card eject mechanism and switch contacts assembled on a base of the electrical card connector of the present invention.

Referring to FIGS. 1 and 2, in assembly, the switch contacts 50 are mounted in the second arm 15 of the insulative base 10. The card eject mechanism 40 is mounted to the first arm 14 of the insulative base 10. The movable member 42 is slidably received in the groove 17 of the first arm 14. The coil spring 43 has a front end secured to the traverse portion 13 of the insulative base 10 and a rear end received in the channel 422 of the movable member 42. The front end 412 of the link rod 41 is disposed in the guiding groove 421 of the movable member 42 in a releasing position "B". The rear end 411 of the link rod 41 is received in the traverse part 112 of the locking indentation 11. The L-shaped retention element 44 is received in the L-shaped locking recess 161. A rear end of the retention element 44 extends out of the recess 161 and abuts against the link rod 41 for preventing the front end 412 of the link rod 41 from disengaging from the guide groove 421.

Figure 3:
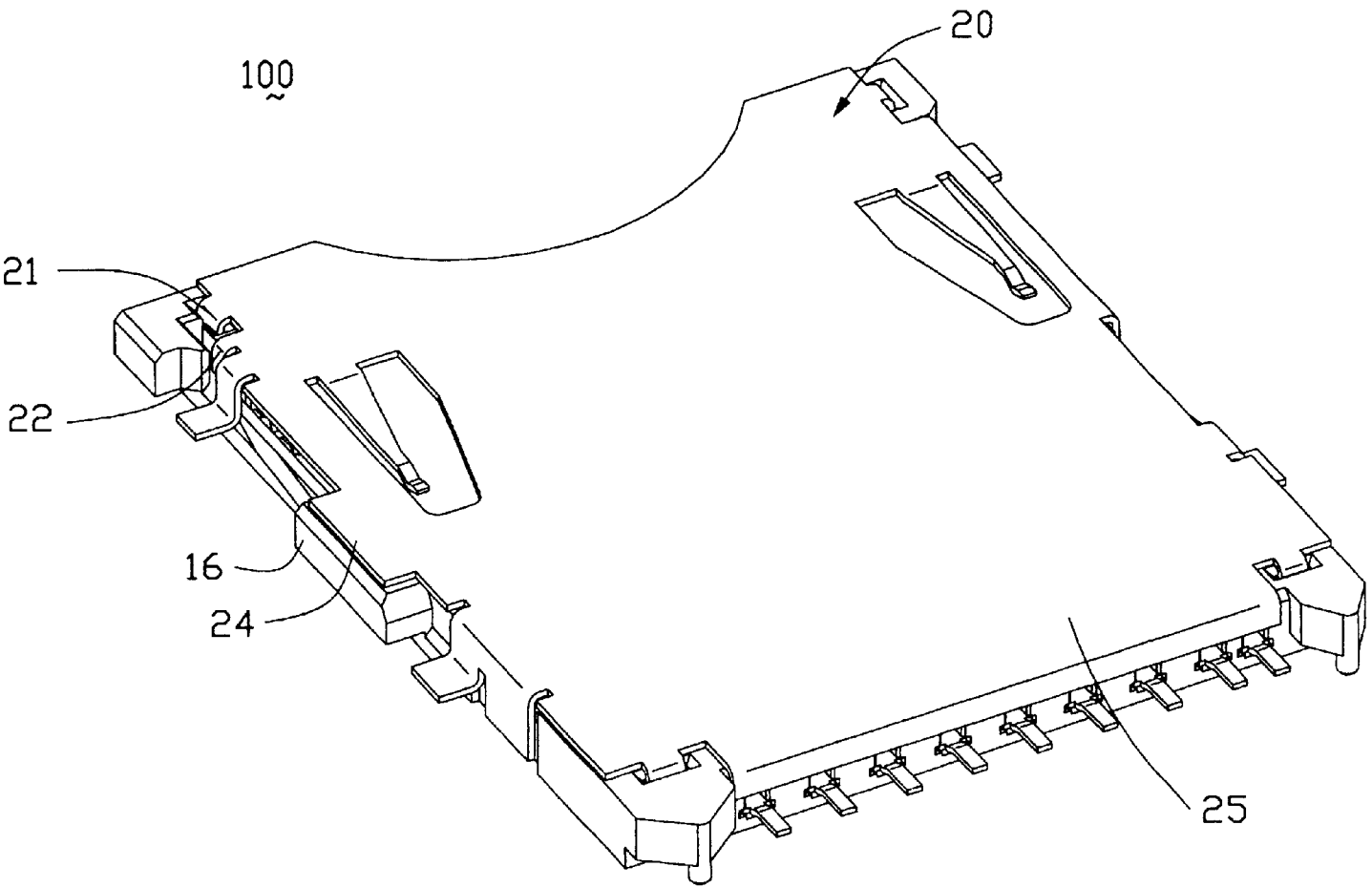
FIG. 3 is an assembled view of FIG. 1.
Figure 4:
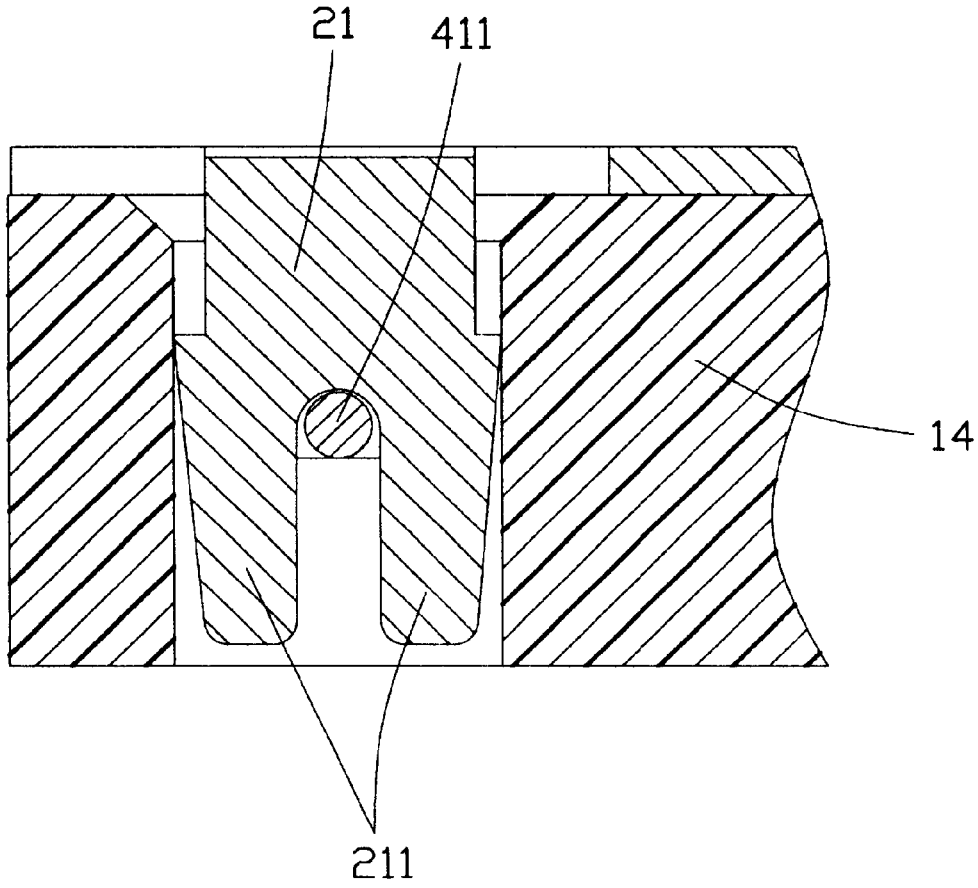
FIG. 4 is a partially cross-sectional view of the electrical card connector of the present invention, showing a rear end of a link rod received between a pair of legs of a shield.
Figure 5:
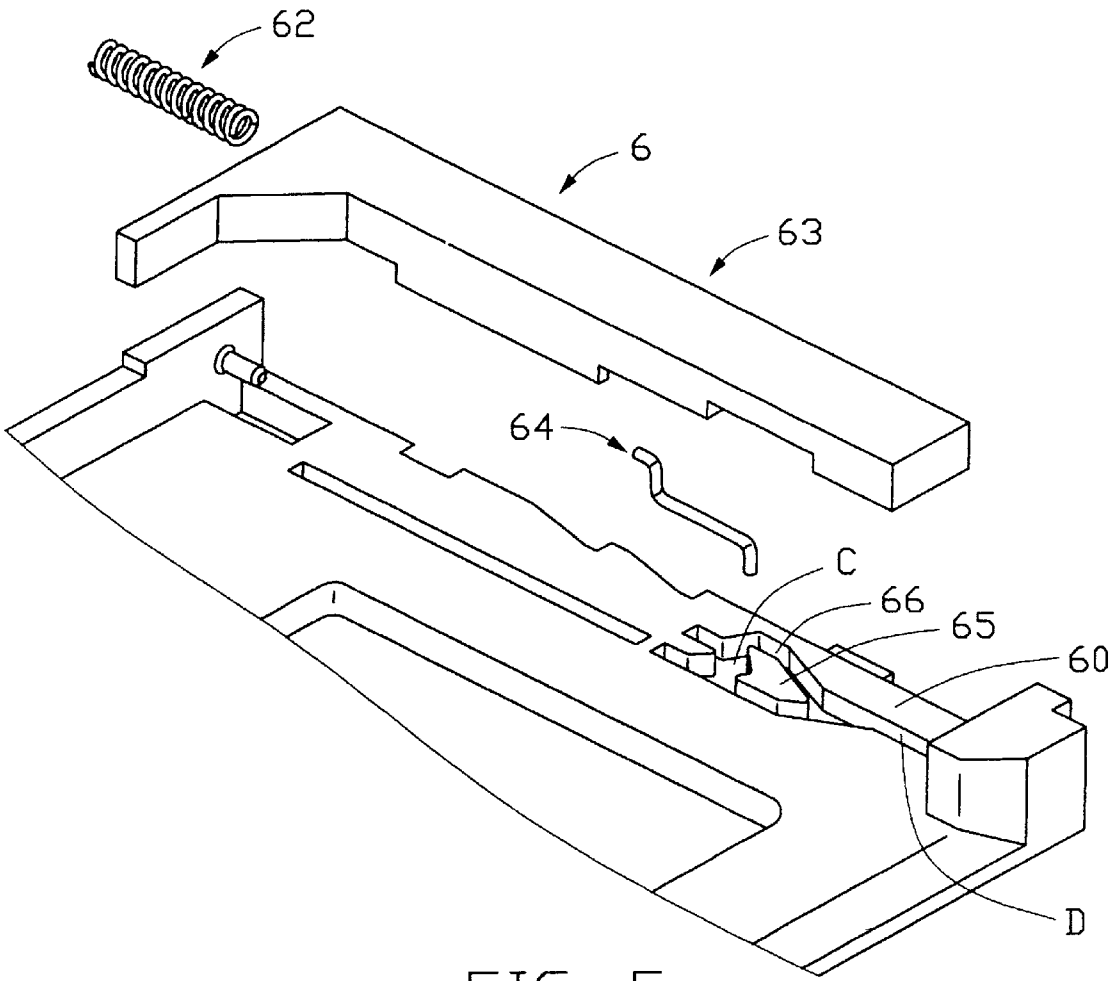
FIG. 5 (PRIOR ART)
FIG. 5 is a schematic view showing a card eject mechanism of a conventional electrical card connector.

Referring to FIGS. 3 and 4, the shield 20 is attached to the base 10. The forked hook 21 engages in the longitudinal part 111 of the indention 11, with the rear end 411 of the link rod 41 sandwiched between the legs 211, thereby securing the rear end 411 of the link rod 41 to the base 10. The tab 22 of the shield 20 abuts against an outside of a rear portion of the link rod 41 for preventing the link rod 41 from deviating outwardly.

During the insertion of an electronic card into the electrical card connector 100, the actuation portion 423 of the movable member 42 abuts against a front end of the electronic card. The movable member 42 moves forwardly together with the electronic card. The coil spring 43 is compressed. The front end 412 of the link rod 41 slides in the guide groove 421. When the card is fully inserted in the electrical card connector 100, the front end 412 of the link rod 41 is locked in a locking position "A" of the guide groove 421. When further exerting a forward force on the fully inserted card, the card, together with the movable member 42, moves rearwardly. The front end 412 of the link rod 41 moves in the guide groove 421 from the locking position "A" to the original releasing position "B". The compressed coil spring 43 exerts a rearward force on the movable member 42, thereby exerting a rearward force on the front end of the electronic card via the actuation portion 423. The electronic card is thus pushed out of the electrical card connector 100.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical card connector comprising:

an insulative base including a traverse portion, and a first and a second arms extending from the traverse portion, the first arm defining a locking indentation;

a plurality of contacts received in the traverse portion;

a metal shield having a main body covering the insulative base and a hook extending from a lateral side of the main body; and a card eject mechanism mounted on the first arm of the base, the card eject mechanism including:

a movable member;

a coil spring having one end connected to the base and the other end connected with the movable member; and a link rod having a first end engaging with the movable member and being moveable from a locking position to a releasing position in the movable member and a second end received in the locking indentation of the first arm;

wherein the hook of the shield is received in the locking indentation and engaged with said second end of the link rod, thereby securing said second end of the link rod to the base; wherein the locking indentation of the insulative base includes a longitudinal part and a traverse part respectively receiving the hook of the shield and said second end of the link rod therein; wherein the hook of the shield comprises two legs, and said second end of the link rod is received between the legs; wherein the movable member defines a guide groove in a lateral side thereof, the first end of the link rod being received in the guide groove.

2. The electrical card connector according to claim 1, wherein the shield includes downward tab extending adjacent to the hook and abuts against a of a rear portion of the link.

3. The electrical card connector according to claim 1, wherein the insulative base has a locking recess, and wherein the card eject mechanism further includes a retention element partially received in the locking recess and abutting against the link rod.

4. The electrical card connector according to claim 1, wherein the card eject mechanism further includes a retention element secured to the base and abutting against the link rod.

5. The electrical card connector according to claim 1, wherein the movable member defines a channel, and wherein said the other end of the coil spring is received in the channel of the movable member.

6. The electrical connector according to claim 1, wherein the guide groove encloses a heart-shaped cam.

7. The electrical card connector according to claim 6, wherein the locking position of the movable member is located farther from the traverse portion of the insulative base than the releasing portion.

* * * * *